US005472026A

United States Patent [19]

Herbst et al.

[11] Patent Number: 5,472,026

[45] Date of Patent: Dec. 5, 1995

[54] TONER LOADING SYSTEM HAVING A SWIVELING EXTENDIBLE FILLER SNOUT

[75] Inventors: Karl L. Herbst, Los Gatos; Peter B. Simons, Tiburon, both of Calif.

[73] Assignee: T.B.S. Printware Corporation, Fremont, Calif.

[21] Appl. No.: 270,754

[22] Filed: Jul. 5, 1994

[51] Int. Cl.[6] ..... B65B 1/04; B65B 3/00

[52] U.S. Cl. ..... 141/383; 141/364; 141/375; 141/387; 141/319; 141/18; 285/272; 355/260

[58] Field of Search ..... 141/363–366, 141/375, 383, 387, 330, 329, 18, 319, 320, 321, 322; 222/DIG. 1; 355/260; 285/272, 150, 151, 175

[56] References Cited

U.S. PATENT DOCUMENTS

| | | | |
|---|---|---|---|
| 4,060,105 | 11/1977 | Feldelsen et al. | 141/1 |
| 4,140,160 | 2/1979 | Glackin | 141/364 X |
| 4,371,015 | 2/1983 | Simons | 141/363 X |
| 4,465,112 | 8/1984 | Kopp | 141/364 X |
| 4,615,364 | 10/1986 | Kawata | 141/364 |
| 4,744,493 | 5/1988 | Ikesue et al. | 141/363 X |
| 4,752,807 | 6/1988 | Mort | 355/260 |
| 4,942,472 | 7/1990 | Mort et al. | 355/260 |
| 5,260,748 | 11/1993 | Kahle | 355/260 X |
| 5,313,993 | 5/1994 | Corby et al. | 141/364 |

*Primary Examiner*—Henry J. Recla
*Assistant Examiner*—Steven O. Douglas
*Attorney, Agent, or Firm*—David E. Newhouse

[57] ABSTRACT

A system for loading toner into a large capacity printer and copier machines includes a base adapter with a swiveling filler snout for receiving and latching onto a spout of a large toner container. The axis of filler snout is oriented at angle Φ with respect to its swivel axis which in turn is tilted at angle Φ with respect to the vertical. Accordingly, the filler swivels between a retracted stow position where the filler snout extends vertically over the base adapter and an extended position where the snout tilts at angle 2Φ from the vertical for receiving and latching onto the spout of the toner container. The spout of the toner container and the mouth of the filler snout have mating surfaces facilitating latching of the container spout within the snout.

11 Claims, 10 Drawing Sheets

FIG. 9
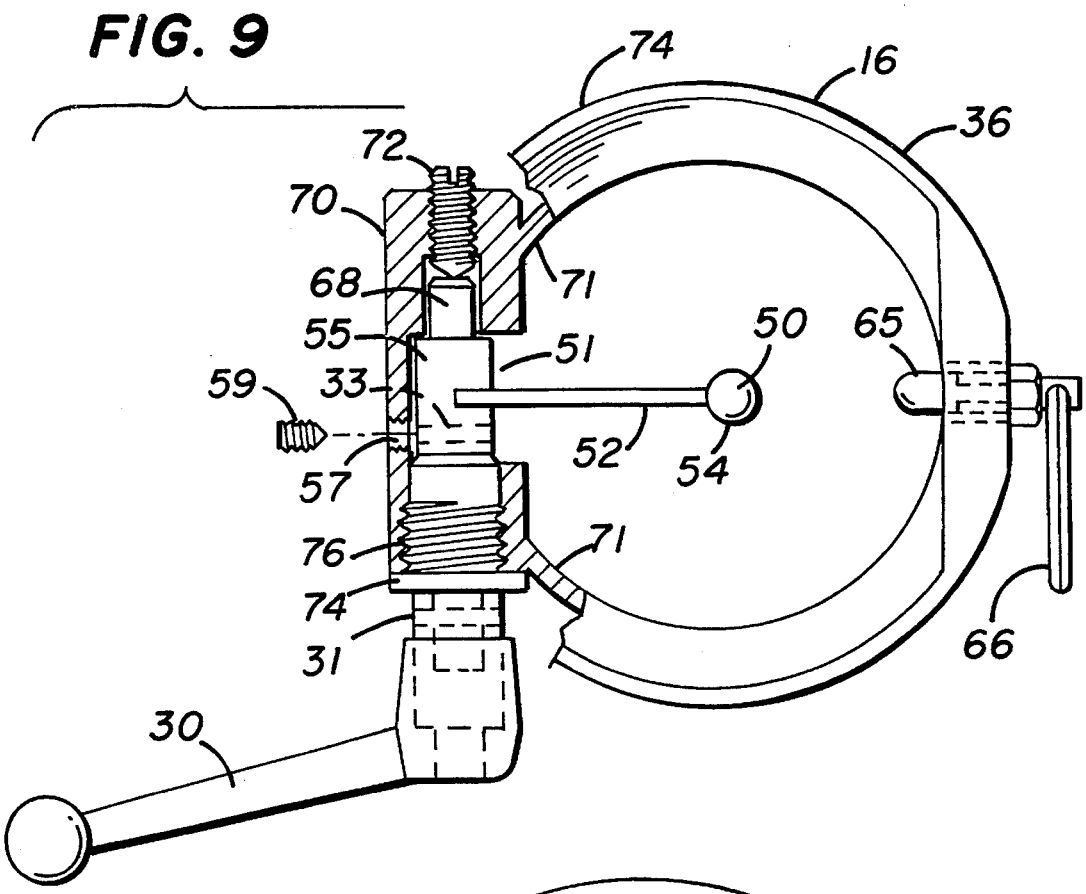
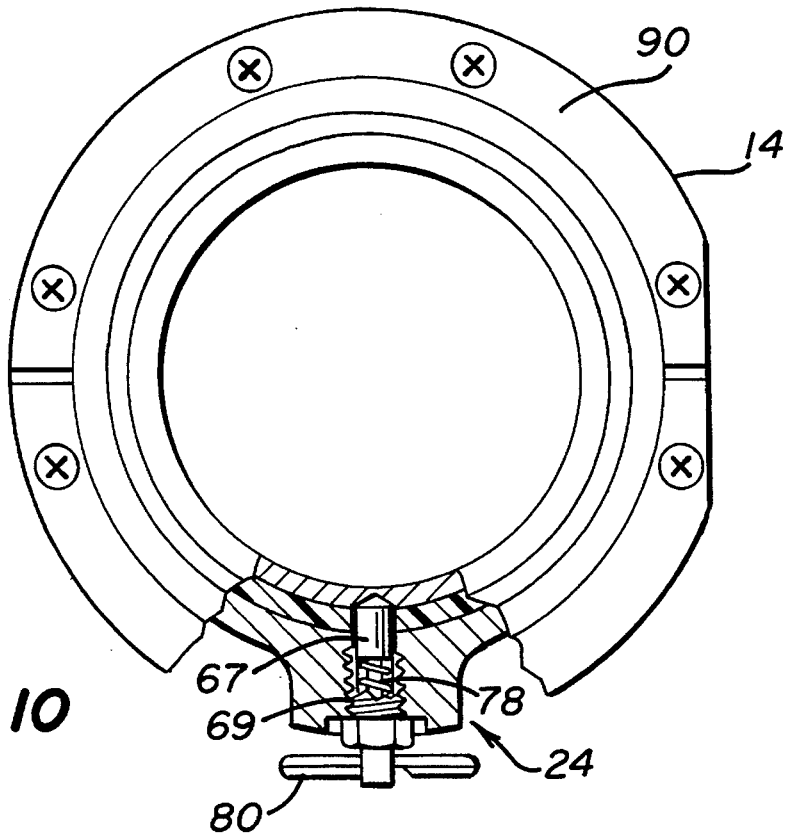
FIG. 10

TONER LOADING SYSTEM HAVING A SWIVELING EXTENDIBLE FILLER SNOUT

BACKGROUND OF THE INVENTION

1. Field of the Invention

The present invention relates generally to toner printing and copying machines, and more particularly to a system for conveniently loading toner into such machines without making a mess.

2. Description of the Prior Art

Many printer and most copier machines utilize a carbon type toner which is applied to paper utilizing a xerographic process to create/duplicate images. In many smaller machines, toner is supplied by a toner cartridge. When the toner is used up, the empty toner cartridge is typically discarded and replaced with a full cartridge. When replacing a toner cartridge an operator usually takes great care to avoid spillage. A mistake during toner cartridge replacement can permanently soil clothing, ruin carpet and generally make a big mess. However, high capacity printers and copiers do not utilize small toner cartridges, but rather toner is typically poured or loaded into the machine via a toner port or inlet in fluid communication with a toner hopper from large bulk storage containers. Depending on the machine, adding toner from typical bulk containers is fraught with opportunities for spillage and is typically very messy.

The present Applicants have previously addressed the hazards of toner spillage during loading. For example, in U.S. Pat. No. 4,371,015, entitled "Toner Loading System Having a Cartridge with a Displaceable Diaphragm" the Applicants describe a filler neck assembly which when attached to a machine, extends at a predetermined angle from the toner port. The toner container or cartridge has displaceable diaphragm which seals the toner in the container. When the toner container is inserted into the filler neck, a displaceable diaphragm is driven against a fixed pin which pops (displaces) the diaphragm into the interior of the cartridge allowing the toner to pour from the cartridge container into the hopper via the filler neck assembly. Seals between the filler neck assembly and the inserted spout end of the cartridge prevent spillage during toner loading. However, Applicant's prior system can not be adapted to printers and copiers where lateral space not is unavailable to accommodate a permanent extending filler neck assembly.

For example, the IBM 3900 Laser Printer, has a toner loader system which minimizes lateral space by providing a toner loader port mechanism which rotates with a toner bottle from a relatively upright position shown in FIG. 1*a* to an upside down position as shown in FIG. 1*b*. After the toner flows from the container into the machine, the container must be rotated back to the up-right position and removed. Typically two large toner containers are loaded into the printer at each loading.

While conserving lateral space, the IBM 3900 Laser Printer toner port mechanism is difficult and cumbersome to work with, i.e. it simply is not designed to avoid spills. Each toner container must first be opened before it is coupled at an awkward angle to the port mechanism for rotation from the coupling position to an upside down position. Then the empty container must be de-coupled from the port mechanism and removed. In particular, because space is limited and the toner containers large, messy spills often occur during loading. And, inevitably, when an empty container is returned to the coupling position and removed from the rotating port mechanism, small amounts of toner spill out the port. Other disadvantages of such rotating port mechanisms relate to preemption of a large radius along the side of the machine to allow for rotation of the toner containers. Still other disadvantages relate to wear and integrity of the rotating collar mechanism of the port. In short, a convenient, spill free, toner loader system is desired for the IBM 3900 Laser printers and many other similar large capacity toner printer and copier machines.

SUMMARY OF THE INVENTION

A convenient, spill free, toner loader system or mechanism for printing and copying machines is described wherein a filler snout attached to a toner port of the machine swivels in a tilted plane from a normally retracted, compact, or stow position to an extended position for conveniently receiving a spout of a large toner container. The filler snout includes an interior orienting surface cooperating with exterior surface of the toner container spout for mechanically seating the spout within the snout and securing it with a detent latch. A multi-function handle at the base of the filler snout actuates a pin assembly within the filler snout for popping out a displaceable diaphragm sealing the spout into the interior of the container spout. The multi-function handle also provides leverage for swiveling the filler snout between the stow and extended positions. The displaceable diaphragm being slightly larger than the spout opening always stays within the toner container as the toner flows into and/or is transported to the toner hopper within the machine.

An aspect of the invented spill free, toner loader system is the cooperation of the orienting surfaces of the filler snout and spout, the detent latch securing the spout within the filler snout and the manually actuated pin assembly popping the displaceable diaphragm closing the spout once the container spout is latched in the filler snout.

Other aspects the invented spill free, toner loader system relate to the handle which serves to swivel a filler spout and to mechanically actuates a pin assembly for dislodging the diaphragm closing the toner container spout.

Particular advantages of the invented spill free, toner loader system relate to the convenience of a swiveling filler snout tilted at angle $\Phi$ relative to its swivel axis which in turn is tilted at angle $\Phi$ relative to the vertical so that the filler snout swivels between a compact stow configuration orinented perpendicularly above the adaptor base and an extended position tilting at angle $2\Phi$ from the vertical for conveniently receiving and latching onto an inserted, cooperating spout of a large toner container.

Other advantages of the invented system relate to space efficiency.

BRIEF DESCRIPTION OF THE DRAWINGS

FIG. 9 is a cross-section of a toner loader as seen along the line A—A in FIG. 9.

FIG. 10 is a cross-section of a toner loader as seen along the line B—B in FIG. 9.

DESCRIPTION OF TIME PREFERRED AND EXEMPLARY EMBODIMENTS

The invented spill free, toner loader system is describe in context of a IBM 3900 Laser Printer which is a typical large capacity toner printing machine.

FIGS. 1*a–d* show the sequence for loading toner into an IBM 3900 Laser Printer using the manufacturer's toner loading mechanism. With reference to pages 106–108 of the Operator's Guide accompanying the IBM 3900 Laser printer, to load toner into the printer, after removing lids closing both the toner bottle and the toner inlet, the operator is instructed to:

1. Attach the toner bottle to the toner inlet by: (FIG. 1*a*)
   a. Aligning a triangle on the toner bottle with a triangle on the toner inlet;
   b. Inserting the bottle neck into the toner-inlet opening; and
   c. Pushing up on the bottle and rotating it clockwise until the bottle is locked securely in the inlet with the wide side of the bottle parallel to the front side of the printer; then to (FIG. 1*b*)
2. Rotate the toner inlet and the attached bottle clockwise 120° to a point where the toner bottle is directly above the toner inlet; and then to (FIG. 1*c*)
3. Press the toner supply push-button at least twice to completely empty one toner bottle transporting toner away out the inlet and into the toner supply hopper of the machine. Rotation indicators on the face of the toner inlet alternately show red and white when the toner feed motor is running. [The operator is cautioned ever press the toner supply push-button unless a toner bottle is attached to the toner inlet, or the toner inlet cap is installed.]

Figure 1A:
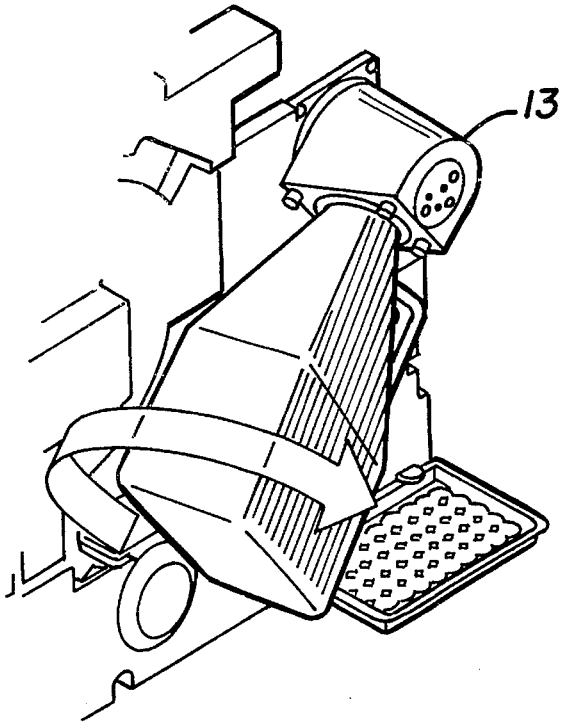
FIG. 1a PRIOR ART
FIG. 1*a–d* are perspective views illustrating and explaining the manufacturer's toner loader system for the IBM 3900 Laser Printer.
Figure 1C:
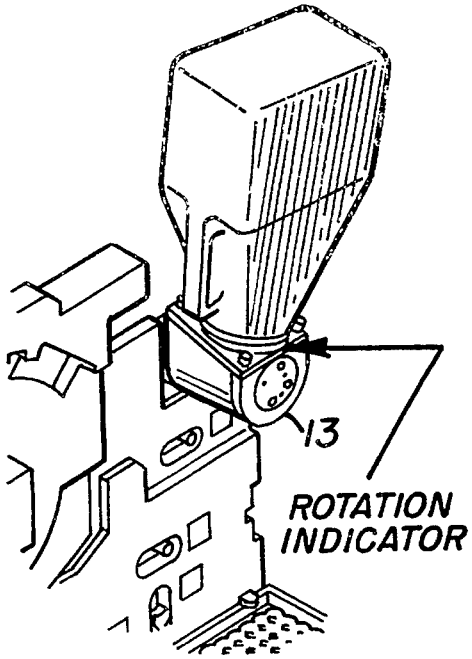
FIG. 1c PRIOR ART
Figure 1B:
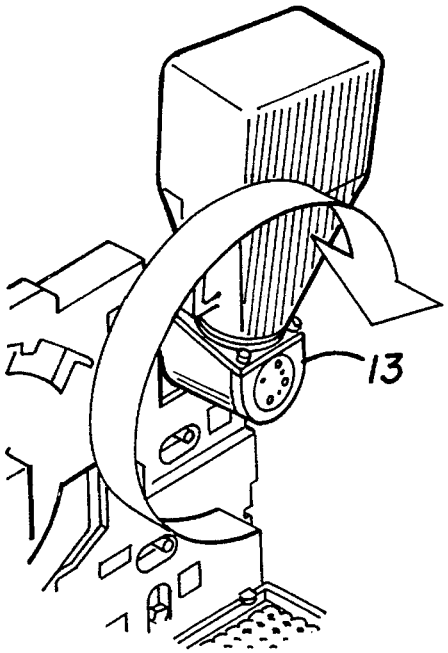
FIG. 1b PRIOR ART
Figure 1D:
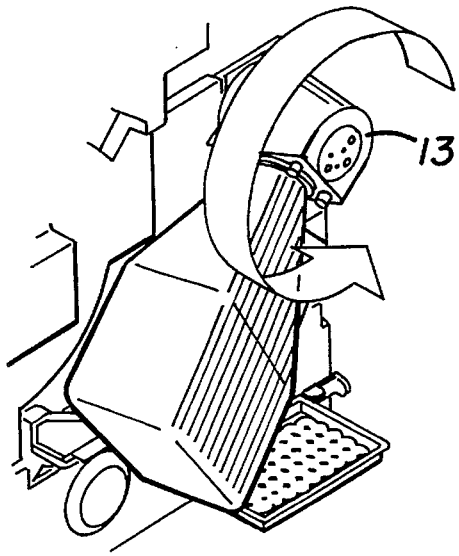
FIG. 1d PRIOR ART

To remove the emptied toner bottle from the toner inlet, the operator is instructed to: (FIG. 1*d*)

4. Rotate the toner inlet and the attached toner bottle approximately 120° counterclockwise to a point where the toner bottle is below the toner inlet; then to
5. Gently tap the toner inlet to move excess toner from the toner inlet back into the bottle, and to then
6. Remove the toner bottle from the toner inlet by:
   a. Pushing up on the bottle and rotating it counterclockwise until the bottle is unlocked from the inlet with the narrow side of the bottle parallel to the front side of the printer; and then
   b. Pulling the neck of the toner bottle out of the toner inlet.

At this stage, if the toner bottle still contains a large amount of toner, the operator is instructed to tap it sharply a few times, and repeat steps 1 through 6b of the procedure outlined above. If the toner bottle is empty, the operator is instructed to repeat the procedure with a second toner bottle to completely fill the toner hopper. One of the empty toner bottles is then the coupled to the waste or toner exhaust port of the machine for capturing and disposing of excess toner and paper dust generated by the printer.

Figure 2A:
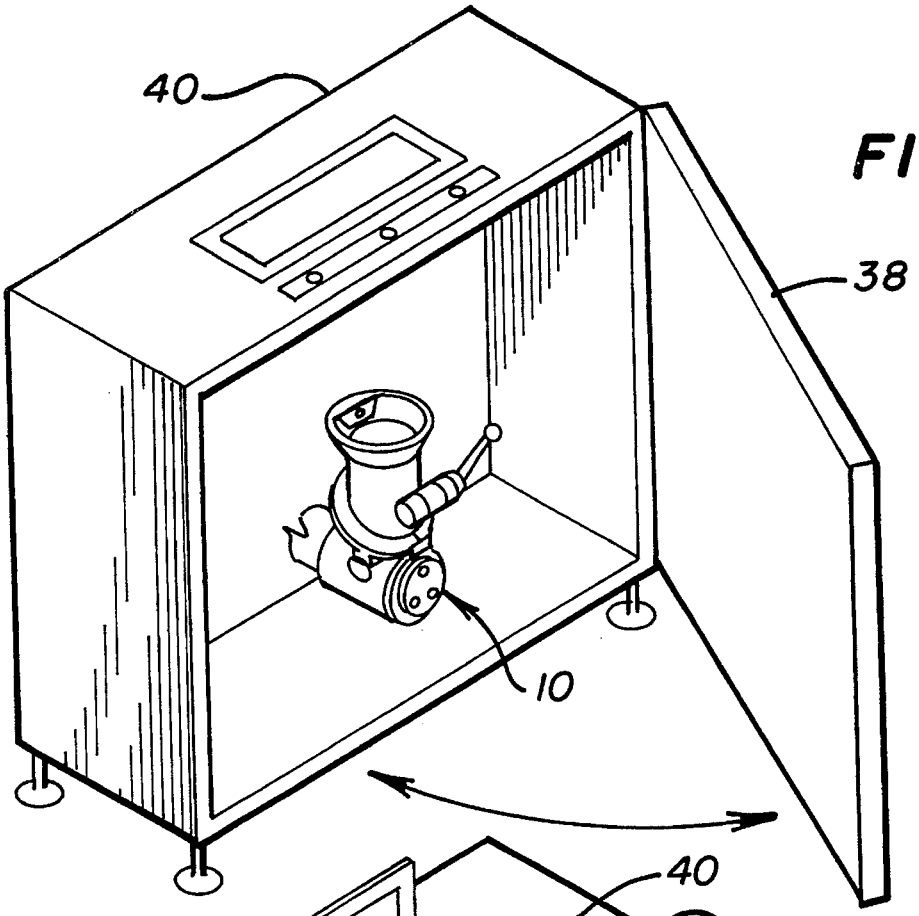
FIG. 2*a–b* are perspective views respectively of the invented spill free, toner loader system adapted for an IBM 3900 Laser Printer.
Figure 2B:
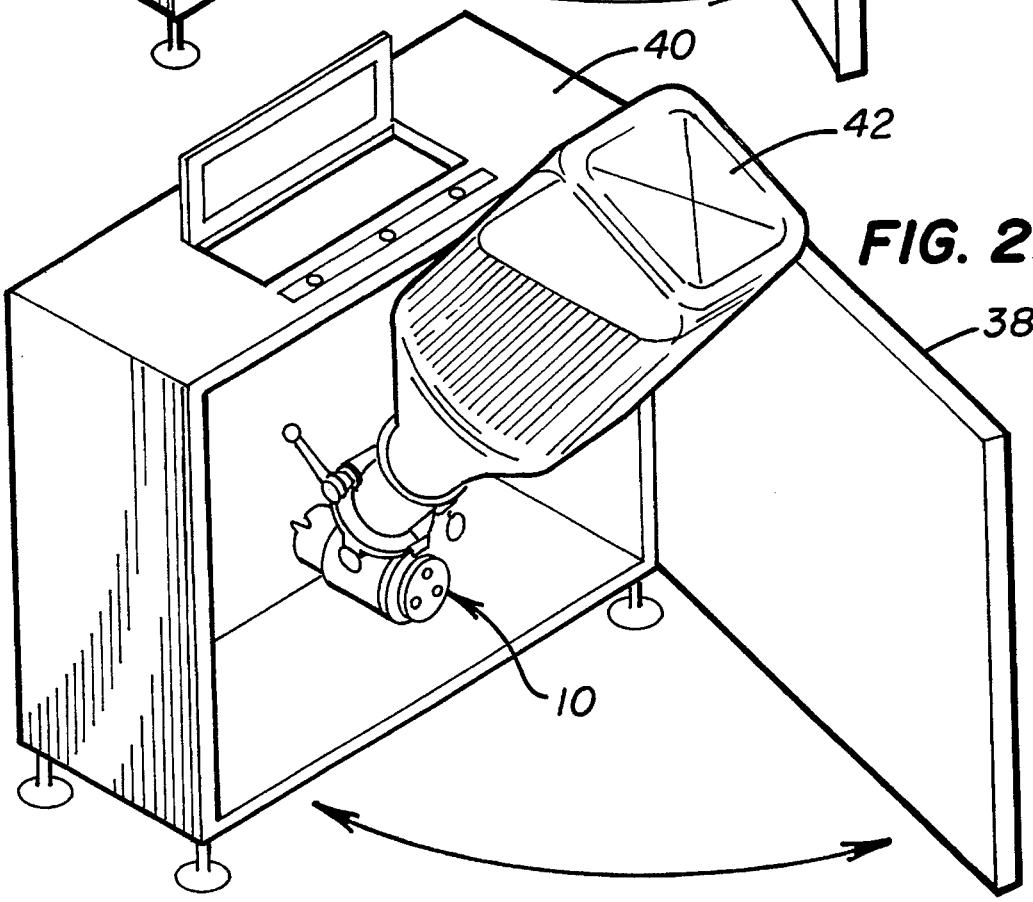
Figure 3:
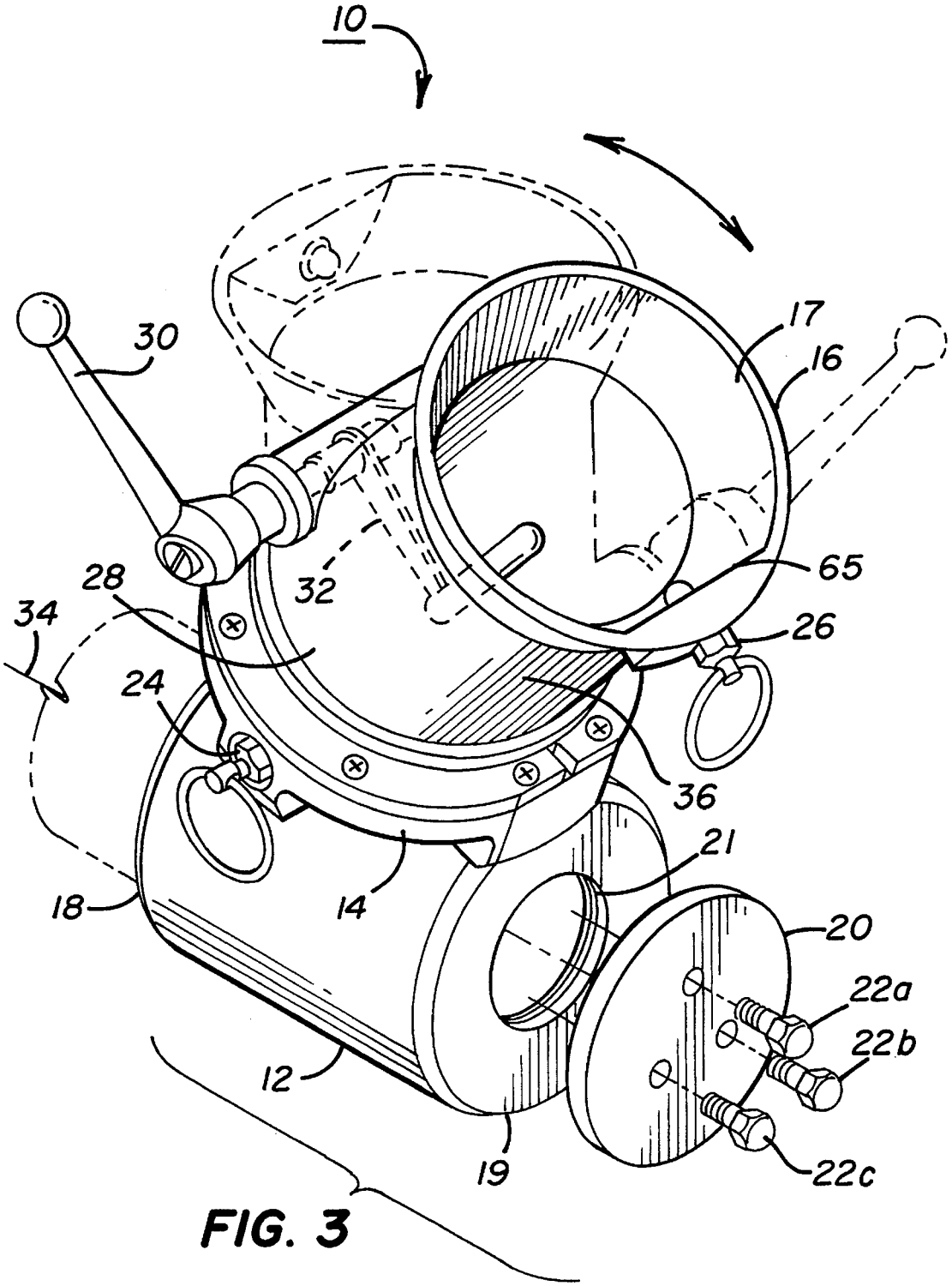
FIG. 3 is a perspective view of a toner loader showing the stow (phantom) and extended position of the filler snout.

The invented spill free, toner loader system 10 adapted for a IBM 3900 Laser Printer 11, with reference to FIGS. 2*a*, 2*b*, and 3, includes a swiveling filler snout 36, a toner container 42 with a shaped spout 58 and an adapter base 12. The adapter base 12 is adapted to replace the rotating the toner inlet housing 13 shown in FIGS. 1*a–d*. [See also FIGS. 7 & 9 which illustrate details of an auger toner transport mechanism 56 within the adapter base 12.] The filler snout 36 of the invented toner loader system 10 swivels about an axis tilted at angle Φ from the vertical between a retracted or stow position and an extended position. In the stow position (FIG. 2*a*) a door 38 of a protective housing 40 is permitted to close enclosing the printer 11. With door 38 open, the filler snout 36 is rotated to an extended position (shown in FIG. 2*b*) angled for conveniently allowing the spout 58 of a toner container 42 to be inserted into the filler snout 36.

In particular, as illustrated in FIGS. 3, 4, 6 & 7 the adapter base 12 provides an annular platform 14 tilted at an angle Φ relative to the horizontal. The filler snout 36 mounts for rotation on the annular platform 14 and includes a cylindrical snout mouth 16 with a longitudinal axis tilted at angle Φ relative to the swivel axis of the filler snout 36 on the annular platform 14. Accordingly, in the stow position the cylindrical mouth 16 of the snout 36 is aligned perpendicularly above the adaptor base 12 with its longitudinal axis in a vertical plane (See FIG. 4), while in the extended position, the snout 36 is aligned with its longitudinal axis tilting at angle α relative to the horizontal plane where $\alpha=(90°-2\Phi)$. In the particular embodiment illustrated for the IBM 3900 Laser Printer, the annular platform 14 is tilted at an angle of 20° below the horizontal, i.e. $\Phi=20°$, and accordingly, the cylindrical mouth 16 of the filler spout 36 extends above the horizontal at angle of 50° in the extended position, i.e., $\alpha=50°$. To assure that all the toner flows completely out of the container 42, annular platform 14 should not tilt much more than 25° below the horizontal.

Figure 4:
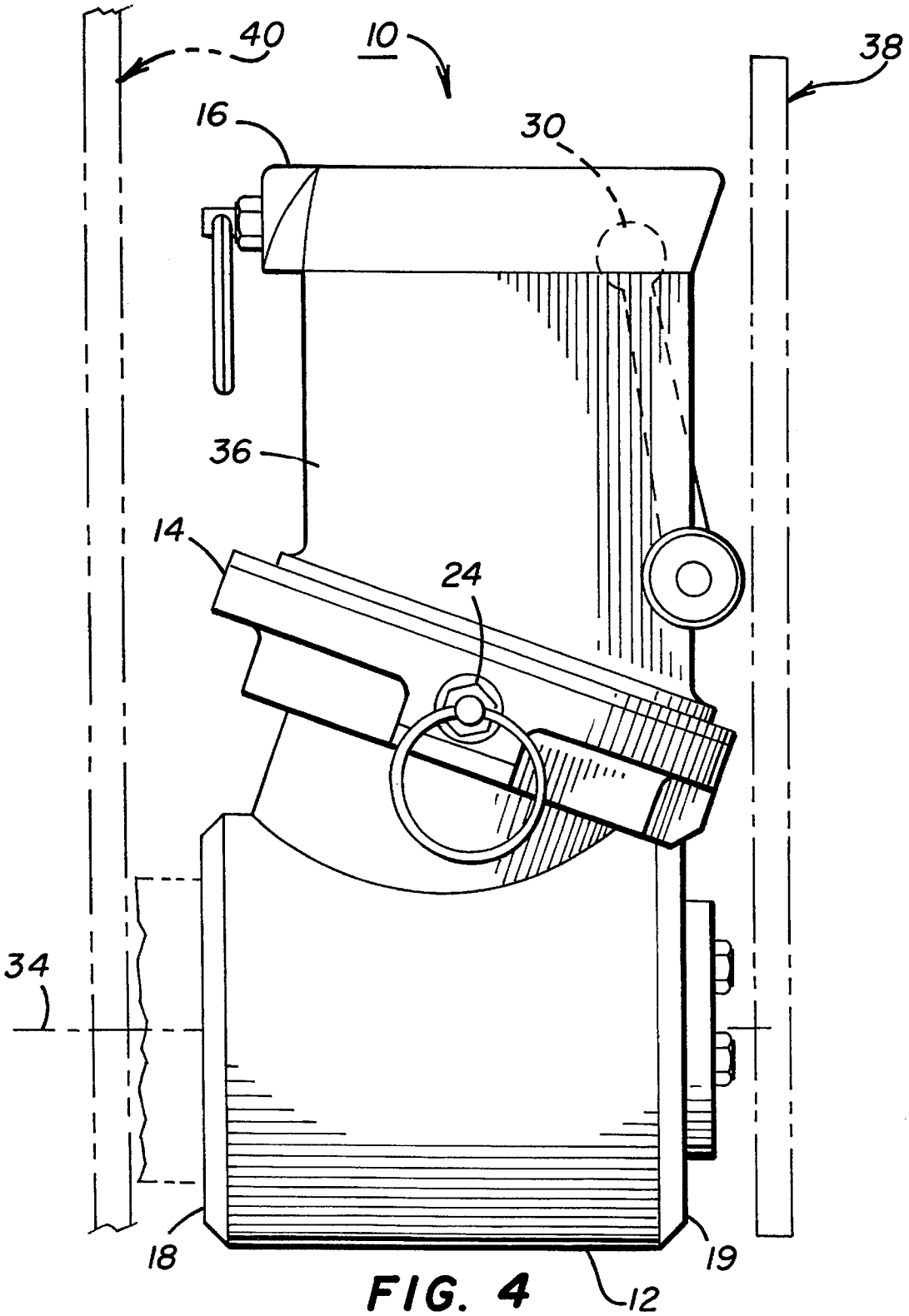
FIG. 4 is a side view of the toner loader with the filler snout in the retracted or stow position.
Figure 5:
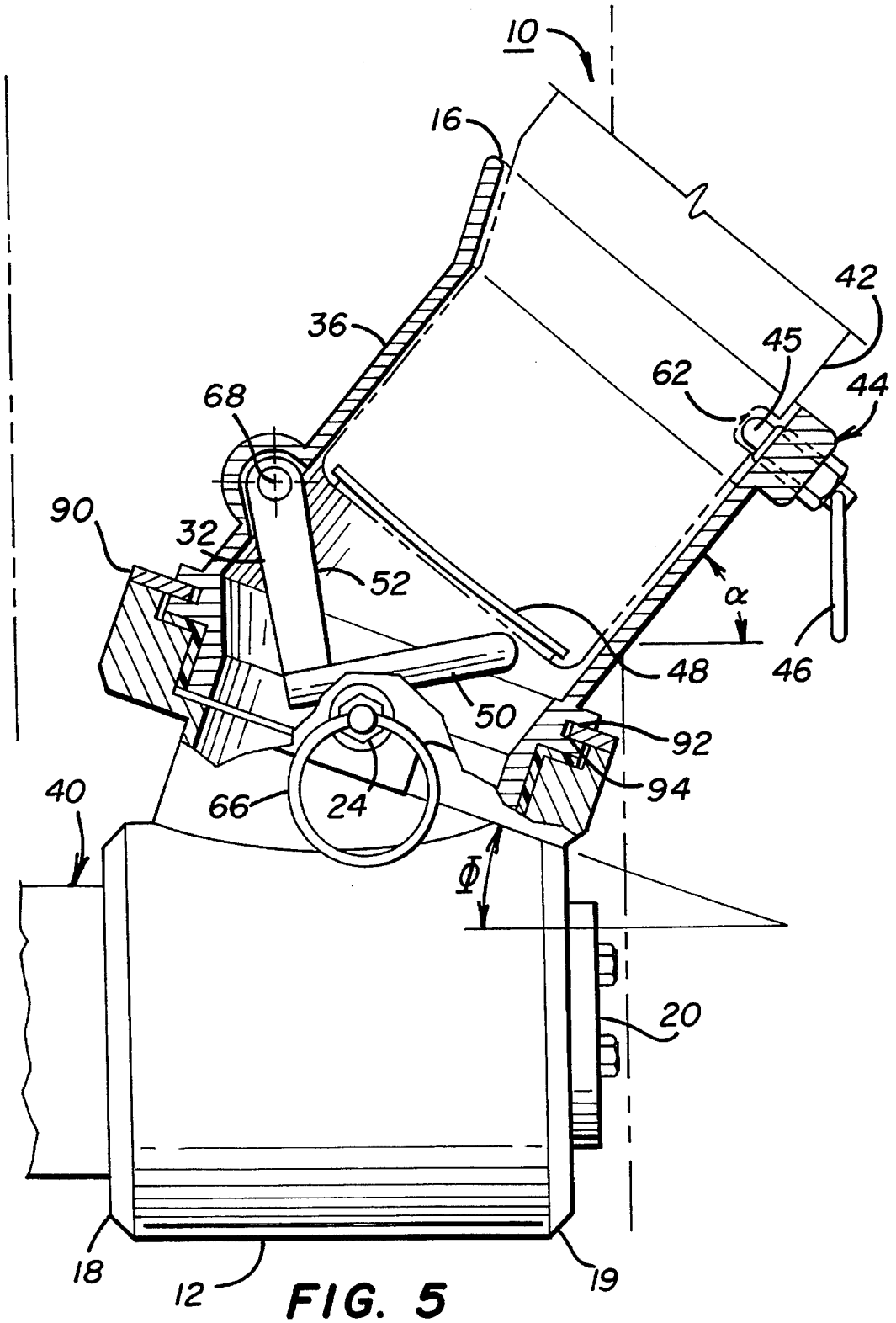
FIG. 5 is a cutaway side view of a toner loader with the snout extended showing the pin assembly at rest.

As shown in FIG. 4, when the filler snout 36 of the toner loader 10 is retracted in the stow position, it occupies a minimal amount of lateral volume directly above the adapter base 12. The multi-function handle 30 stands (behind filler snout 36 as shown) also extends in a generally upward direction to occupy essentially the same lateral volume. Accordingly, in the stow position, neither the filler snout 36, nor its cylindrical mouth 16 nor the handle 30 will prevent door 38 from closing.

Looking at FIGS. 3, 4, 6, 7, 9 & 12, the cylindrical mouth 16 of the filler snout 36 has a conically flared end 17 with a flat cord section 65 for receiving and mating with a conically tapered exterior annular shoulder surface 19 at the base of the spout 58 of the toner container 42. The exterior annular shoulder surface 19 at the base of the spout 58 has a corresponding flat cord section 64. Accordingly, unless the flat cord section 65 of the conically flared end 17 is aligned with the flat cord section 64 of the conically tapered shoulder 19 of the spout 58, the toner container spout 58 will not seat in the filler snout 36. By appropriately adjusting the respective lengths of the respective mating conical surfaces of the flaring end 17 and tapering shoulder 19 at the base of the spout 58, it is possible to prevent the pin 50 from displacing the diaphragm 48 (FIG. 13) closing the spout 58 of the container 42 when the spout is not properly seated. As shown clearly in FIG. 12, a recess 62 is formed into the flat cord section 64 of the conically tapered annular shoulder surface 19 of the toner container spout 58. When the container spout 58 is properly seated within the filler snout 36, the recess 62 registers for receiving a spring actuated, detent latch 44 which secures the toner container 42, with its spout 58 seated within the filler snout 36. [See FIGS. 6–9] To remove the toner container 42 from the filler snout 36, the spring actuated peg 45 of the detent latch 44 is retracted by pulling ring handle 46 outward. Occasionally peg 45 may have to be retracted to allow the toner container spout 58 to be inserted into the snout 36. However, by locating the flat cord section 65 of the conically flared end 17 of the snout 36 at the front of the snout when it is in the extended position, as the operator tips the end of the spout 58 into the snout 36, the weight of the toner will cause the peg 45 to retract, particularly if a conically tapering section shoulder 19 of the spout 58 initially engages the distal end of the peg 45.

Figure 7:
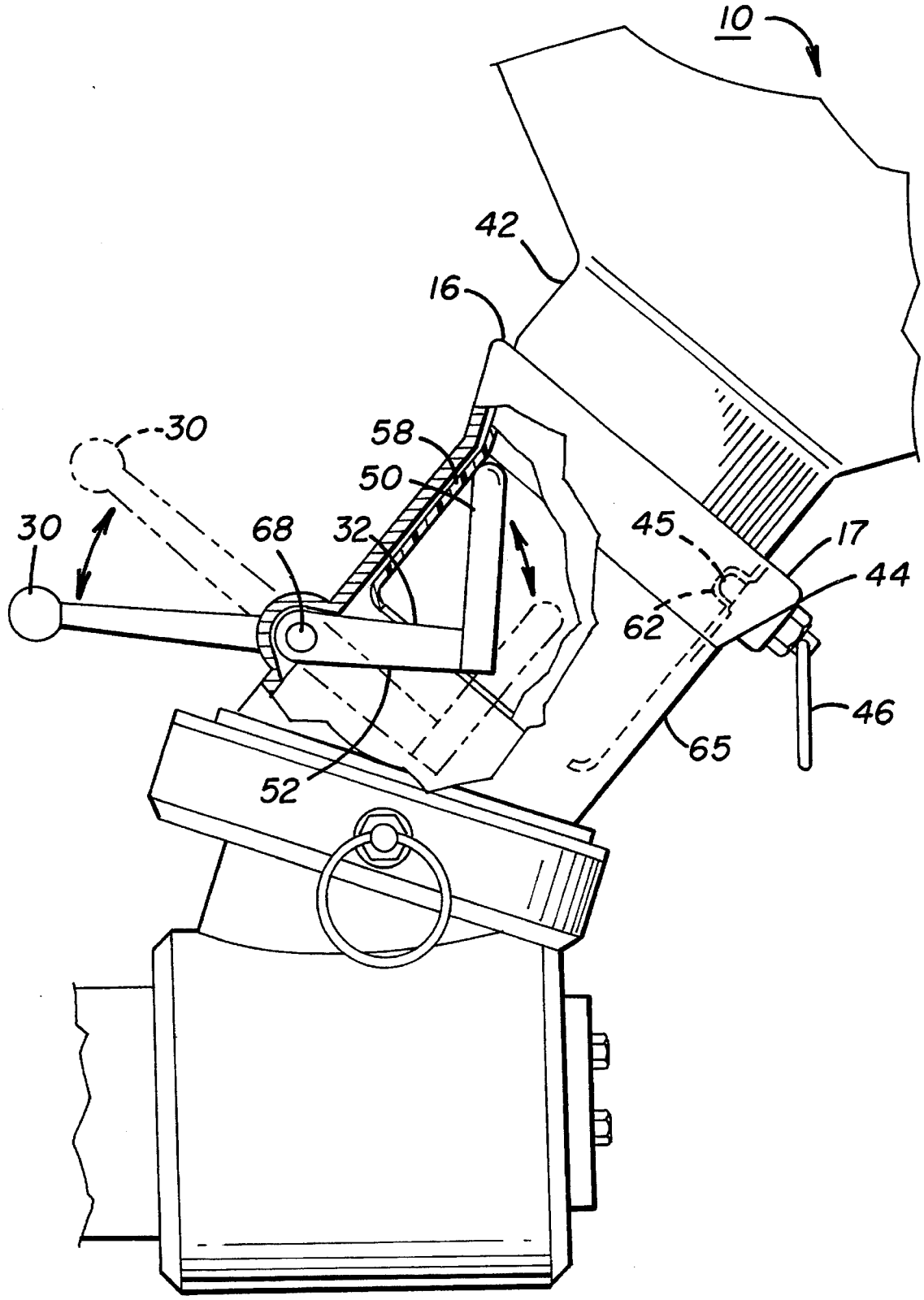
FIG. 7 is a cutaway side view of a toner loader with the snout extended showing the pin assembly engaging the interior surface of a cooperating toner container spout.
Figure 8:
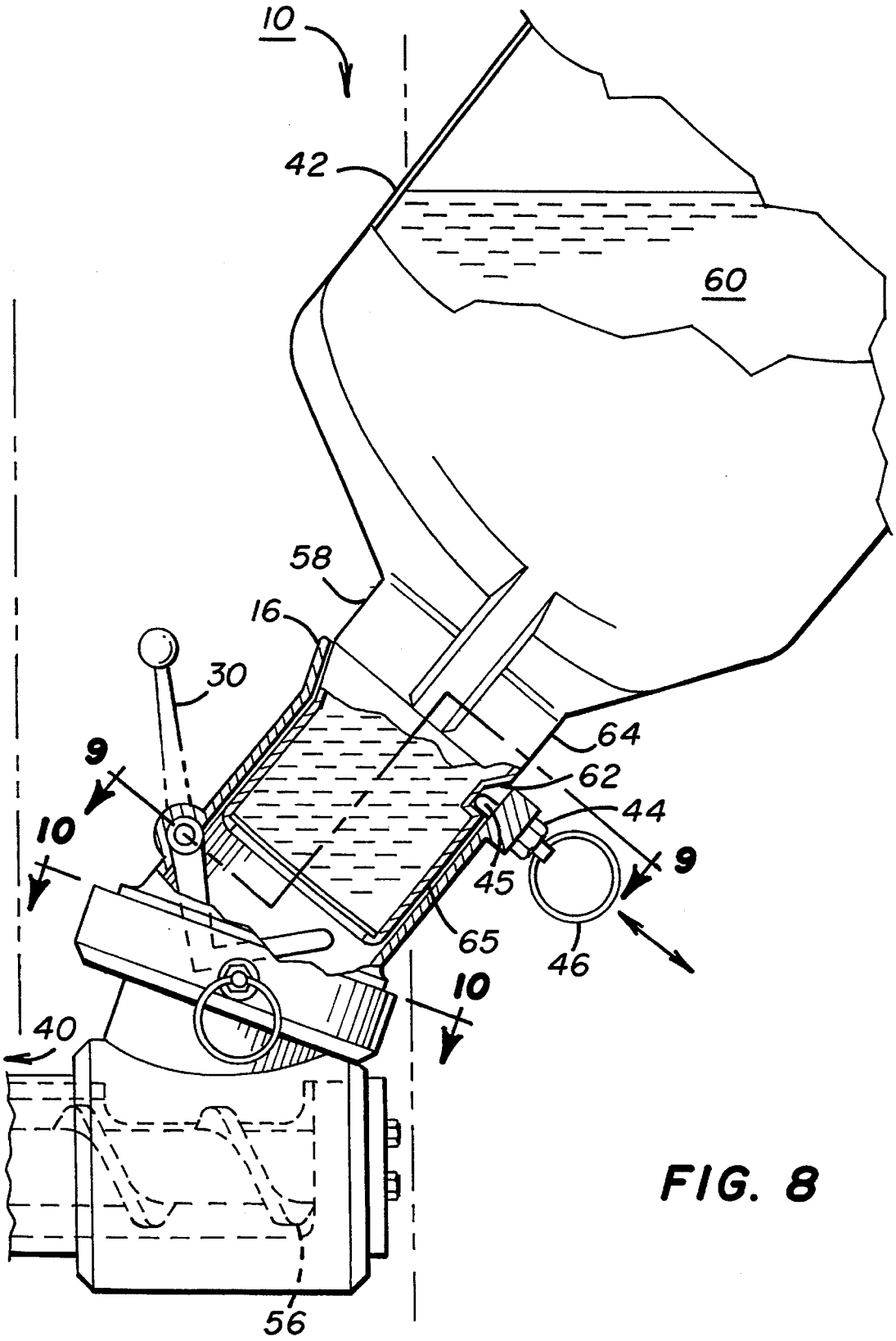
FIG. 8 is a cutaway side view of the filler snout and inserted spout of a toner container showing details of the detent latch securing the container spout in the snout.

In more detail, with reference to FIGS. 7 & 9, the adapter base 12 is hollow and slides onto an extending tubular housing 55 of the auger toner transport mechanism 56 of the printer 11 via a large diameter back opening 18. The tubular housing 55 has an opening 23 through its upper surface proximate its distal end. [The manufacturer's rotating housing adapted to couple to and rotate with the toner bottles as illustrated in FIGS. 1*a–d* for the IBM 3900 Laser Printer is removed and discarded to expose the auger housing 55. The auger toner transport mechanism 56 is part of the IBM 3900 Laser Printer 11 and does not comprise an element of the invented spill free, toner loading system.] The front end 19 of the hollow adapter base 12 includes an annular shoulder 21 with an inner diameter dimensioned to receive a smaller diameter cylindrical end section of the auger housing 55. A cover plate 20 secured by bolts 22*a*–22*c* to the end of the auger housing 55 seats the interior facing surface 23 of the annular shoulder 21 against a pre-existing annular bearing fence 25 extending up from the distal end surface of the auger housing 56. It should be appreciated that the opening 23 through the auger housing 55 may be oriented opening slightly to one side. In all instances, the annular platform 14 should be located vertically above and in direct fluid communication with the opening 23 into the auger housing 55. The cover plate 20 also completes the enclosure of the extending auger housing 55 of the printer 11. Conventional 'O'-rings received in conventional rectangular annular grooves 59 cut into the proximal and distal ends of the adapter base housing 12 establish fluid tight seals for preventing leakage of toner. As shown in FIG. 3, removing bolts 22*a*–22*c* releases the cover plate 20 and allows the adapter base 12 to be removed from auger transport mechanism 56 for cleaning and maintenance. It should be appreciated that details of the adapter housing may differ depending upon the nature and type of toner inlet ports and transport mechanism of different printers and copiers. However designed, the adapter base 12 should establish fluid tight communication between the toner inlet port of the machine and the tilted annular platform 14 of the adapter base 12 upon which the filler snout 36 is mounted and rotated.

Looking at FIGS. 4, 6, 9 & 11, a swivel lock 24 mounted on the adapter base 12 mechanically locks the filler snout 36 in either the extended position (FIG. 6), or the stow position (FIG. 4) on the annular platform 14 of the adapter base 12. In particular, the swivel lock 24 includes a conventional spring 78 and peg 67 mounted in a threaded coupling 69 screwed into a locking port penetrating though the side of the adapter base 12 below the annular platform 14. The spring urges the peg 67 against the periphery of a bottom cylindrical section 75 of the filler snout 36. The tip of the peg 67 engages detents 77 cut into the peripheral surface of cylindrical section 75 for positioning the filler snout 36 in the stow and extended positions. A ring handle 80 attached the peg 67 is pulled to disengage the tip of the peg 67 from detents 77 to permit rotation of filler snout 36 on annular platform 14.

Figure 6:
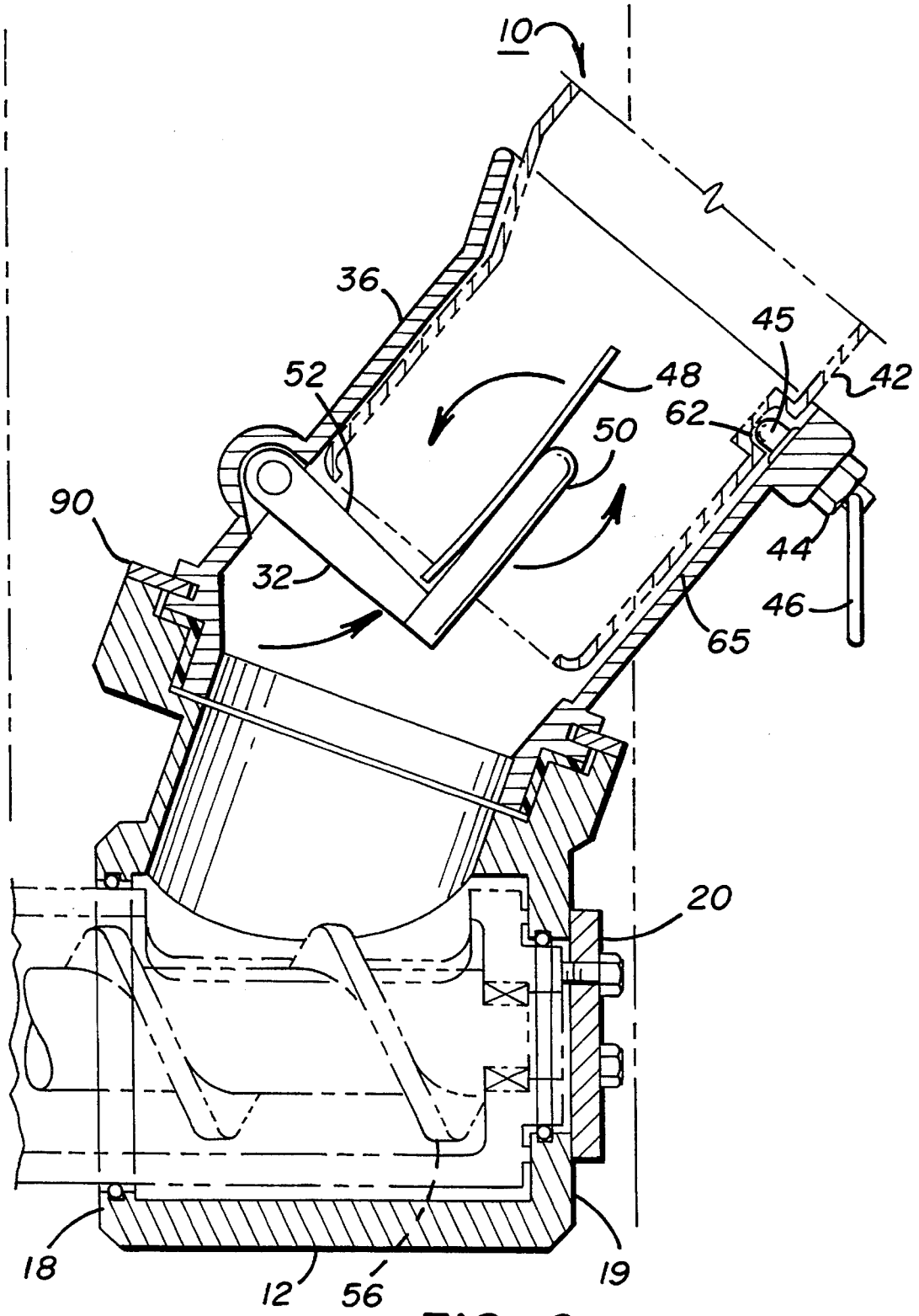
FIG. 6 is a cutaway side view of a toner loader with the snout extended showing the pin assembly displacing a diaphragm closing the spout of a toner container.

Looking at FIGS. 3,6, & 7, the exterior surface of the sidewall 71 of the filler snout 36 includes two parallel annular ridges 92 defining an annular bearing channel 93 around the periphery at the top of the bottom cylindrical section 75 of the filler snout 36. As shown, the entire bottom cylindrical section 75 of the filler snout 36 fits within the cylindrical opening 91 of the annular platform 14 of the adapter base 12. A two semicircular, rigid flanges 90 composed of a polymeric material such as PTFE are fastened on the top end surface of the annular platform 14 and extend radially inward. The inward extending semicircular flanges 90 are snugly received in the annular bearing channel 93 at the top of the bottom cylindrical section 75 of the filler snout 36 for securing the snout 36 for swiveling on the annular platform 14. The particular type of polymeric material chosen for the semicircular flanges 90 should allow the flanges 90 function in a dual capacity, first as a bearing surface for allowing the snout 36 to swivel on the annular platform 14, and second, as a sealant for preventing toner from leaking out at the junction of the filler snout 36 and adapter base 12.

The multi-function handle 30 mounted on the exterior 28 wall of the filler snout 36 functions as a hand-grip for applying tangential forces to filler snout 36 for swiveling it about annular platform 14. The multi-function handle 30 also actuates a shaft 68 extending from bushing 70 of the pin assembly 32 within the filler snout 36.

Details of the pin assembly 32 and associated multi-function handle 30 are illustrated in various cutaway views of FIGS. 3 & 6–10. A displaceable diaphragm 48 of lid 88 (FIG. 13) closing the end of the spout 58 of the toner container 42 is located just above a pin 50 of pin assembly 32 when the container 42 is seated in the filler snout 36. Accordingly, when pin 50 is rotated upward by manually rotating the multi-functin handle downward, pin 50 mechanically engages (FIG. 6) and displaces or 'pops' the diaphragm 48 out of lid 88 into the interior of the container spout 58. (FIG. 7) establishing fluid communication between the toner container 42 and the auger toner transport mechanism 56 of the printer 11.

In more detail, referring to FIGS. 10, the pin assembly 32 comprises a pin 50 extending perpendicularly upward from an arm 52 (FIGS. 3, & 6–9) extending from a sleeve 53 attached by pin 33 to a shaft 68. The arm 52 extends through an opening 51 through the sidewall 71 of the filler snout 36 to a point proximate the center of the snout mouth 16. Shaft 68 is journaled to rotate in a bushing 70 which is either welded to or cast to integrally become a part of the side wall 71 of the filler snout 36. An end of shaft 68 extends coaxially out one end of the bushing 70 exterior the sidewall 71. The multi-function handle 30 is secured to the extending end of shaft 68 by a pin 31 for rotating shaft 68 within the bushing 70. A threaded adapter 74 screws into bushing 70 coaxially around the extending end of shaft 68 to abut against sleeve 53 to secure shaft 68 within the bushing 70. A shaft adjuster or set screw 72 threaded coaxially though the end of the bushing 70 opposite the handle 30 abuts against the remaining end of shaft 68 to provide a mechanism capable of axially translating the shaft 68 for adjusting the lateral position of pin 50 within the snout mouth 16. A pin removal port 57 pierces though the backwall of bushing 70 opposite opening 51 to allow removal of pin 57 securing sleeve 53 to shaft 68. A threaded plug 59 screws into the pin removal port 57 to prevent toner leakage.

When the spout 58 of the toner container 42 is properly seated within the filler snout 36, the tip of pin 50 at the end of arm 52 is at a rest position (FIG. 6) proximate an edge of a displaceable diaphragm 48 of a lid 88 closing the end of the spout 58. (Details of the diaphragm and lid are shown in FIG. 13.) Handle 30 is then manually rotated downward, rotating pin 50 upward in an arc popping diaphragm 48 out of the lid 88 and displacing and positioning it in the interior of the spout 58 such that it minimally disturbs flow of toner from the container 42, i.e. to a position where pin 50 is essentially coaxially aligned within mouth 16 of filler snout 36 (FIG. 7) orienting the diaphragm 48 vertically within the snout mouth 16 with its edge supported by arm 52 of the pin assembly 32. It should be appreciated that axially translation of shaft 68 using the shaft adjuster or set screw 72 allows an operator to optimally locate the tip of pin 50 for popping and displacing the diaphragm 48 out of the lid 88 closing the spout 58 of the toner container 42.

The detent latch 44, mechanically locking the container spout 58 in place within filler snout 36, prevents displacement of the seated container 42 as the diaphragm 48 is popped out by the pin assembly 32. The popping of the diaphragm 48 generates a mechanical shock vibrating the toner container 42 loosening toner 60 within the container inducing it to flow. If additional vibration is needed to induce the toner to flow from the container 42 through the container spout 58 into the auger toner transport mechanism 56 of the printer 11, the multi-function handle 30 can rotate pin 50 to rap its tip against spout 58 of the toner container 42 (FIG. 6). In fact, an operator can rapidly reciprocate multi-function handle 30 to repeatably tap pin 50 against the spout 58 to dislodge toner 60 stuck in the spout 58 and container 42.

Figure 12:
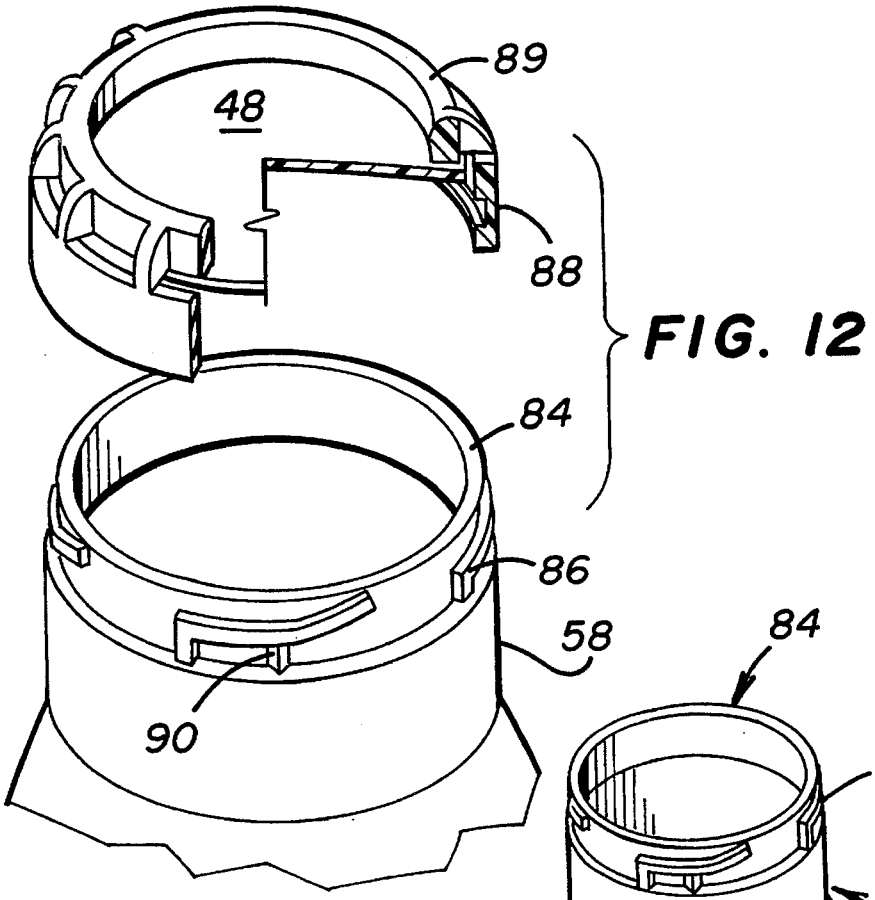
FIG. 12 is an exploded perspective view of the spout of the toner container spout top and associated lid with a displaceable diaphragm.
Figure 11:
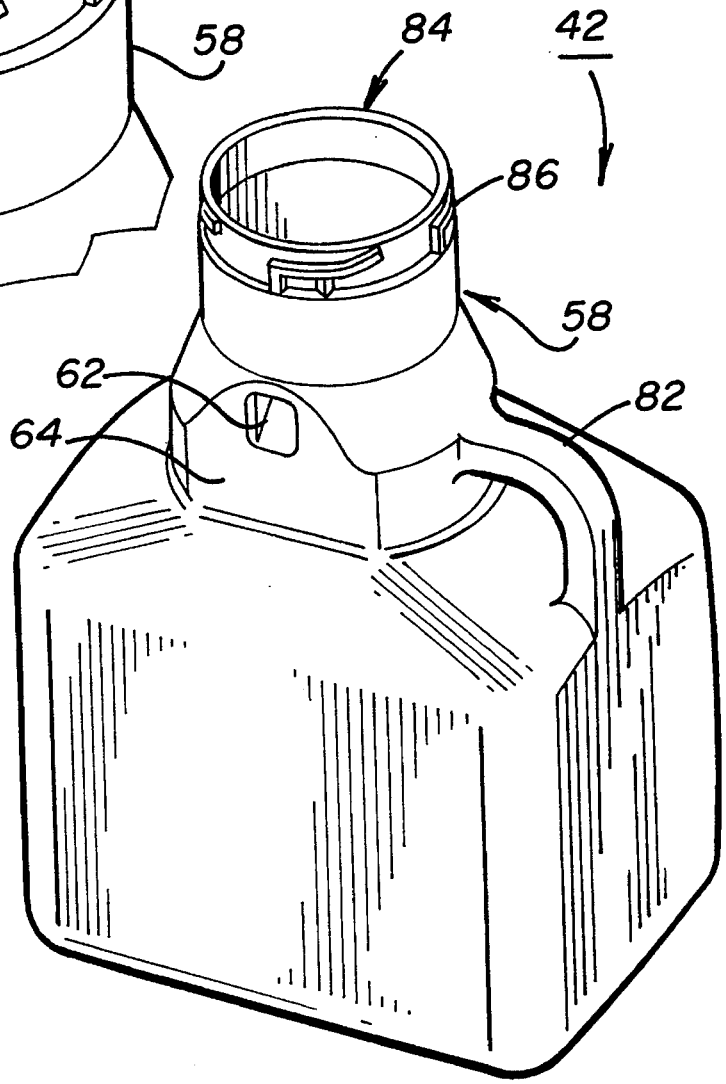
FIG. 11 is a perspective view of a toner container.

Referring to FIG. 12, the fiat cord section 64 of the conically tapered shoulder surface 19 and associated latching recess 62 at the base of the container spout 58 of the toner container 42 are oriented at 90° ninety relative to the container handle 82. Such orientation makes it easier for the operator to align the fiat cord section 64 of the spout 58 of the container 42 with the corresponding f;at cord section 65 of the conically flared end 17 of the filler snout 34. Toner containers 42 are reusable and include exterior inclined lands/threads 86 at the end 84 of the spout 58 for receiving and securing a removable lid 88. As shown in FIG. 13, removable lid 88 includes a diaphragm 88 which does not rupture, but rather responsive to mechanical forces applied by the pin assembly 32, pops inwardly, preferably into a container spout 58. The lid 88 also includes a smaller diameter diaphragm retainer ring 89 for preventing the displaced diaphragm 48 from falling out of the container spout 58 when the container 42 is removed from the filler snout. For extra versatility, the exterior inclined lands/threads 86 at the end of the container spout 58 should be configured to be compatible for coupling with the manufacturer's toner loading mechanism as well as with the toner waste/exhaust port of the printer.

While the invented spill free, toner loader system is described in terms of a preferred and representative embodiment, specifically designed for the IBM 3900 Laser Printer, it should be appreciated that certain changes and modifications can be made, particularly to the adapter base 12, without departing from the spirit and scope of the invention as defined and set forth in the appended claims.

We claim:

1. A system for loading toner into a toner hopper of toner printer and copier machines comprising in combination:

a) a toner container filled with toner formed having a spout with a conically tapering exterior shoulder surface having a flat cord section, b) a removable lid having a displaceable diaphragm closing the spout, c) a base adapter providing an annular platform oriented with an axis tilted relative to a horizontal plane at an angle of 90°–Φ for establishing a fluid coupling to the toner hopper of such machines, and d) a filler snout coupled to the base adapter in fluid communication with the toner hopper having a cylindrical mouth with a longitudinal axis oriented at angle Φ relative to the tilted axis of the annular platform, the filler snout being mounted for swiveling about the tilted axis of the annular platform from a stow position where the cylindrical mouth of the snout is oriented vertically to an extended position where the cylindrical mouth of the snout tilts outward from a vertical side of such machines at angle 2Φ for receiving the spout of the toner container, the cylindrical mouth of the filler snout having a conically flared opening with a flat cord section configured for mating with the conically tapering exterior shoulder surface and flat cord section of the spout of the toner container.

2. The system of claim 1 wherein the filler snout further includes:

e) a cylindrical base section received within the annular platform, the cylindrical base section having a pair of exterior parallel annular ridges defining an exterior, peripheral annular bearing channel;

f) two semicircular flange bearings composed of a rigid polymeric material secured to the a top end of the annular platform and extending radially inward into the exterior, peripheral annular bearing channel around the cylindrical base section of the filler snout, coupling the filler snout to the base adapter enabling it to swivel about the axis of the annular platform.

3. A system of claim 1 or 2 and further including:

g) a pin assembly mounting a pin movable within the cylindrical mouth of the filler snout and having means for mechanically moving the pin against the displaceable diaphragm of the removable lid closing the spout of a toner container inserted into the filler snout to dislodge and displace the diaphragm from the lid, whereby, fluid communication between the toner hopper of the machine and the toner container may be established without removing the lid closing the spout of the toner container.

4. The system of claim 3 wherein the pin assembly comprises, in combination:

(i) a bushing having an opening into the cylindrical mouth of the filler snout integral with a sidewall of the cylindrical mouth;

(ii) a shaft received within and rotatable within the bushing having an end extending coaxially from the bushing exterior the sidewall of the cylindrical mouth;

(iii) an arm secured to the shaft extending through the opening into the cylindrical mouth coupled to the pin; and (iv) a multi-funtion handle fastened to the extending end of the shaft for rotating the shaft within the bushing moving the pin within the cylindrical mouth of the filler snout.

5. The system of claim 4 wherein the annular platform includes a releasable swivel lock including a spring loaded peg which radially penetrates a port drilled through a sidewall of the annular platform of the adapter base and which has a tip adapted to seat into detents located on the cylindrical base section of the filler snout for locking the filler snout in the stow and the release positions, and wherein the bushing of the pin assembly integral with the side wall of the cylindrical mouth of the filler snout is located for allowing the multi-function handle of such pin assembly to be manually grasped for swiveling the filler snout between the stow and extended positions.

6. The system of claim 3 wherein the flat cord section of the conically tapering shoulder of the spout of the toner container has a locking recess, and wherein a releasable detent latching mechanism is mounted exterior the fiat cord section of the conically flared opening of the filler snout having a spring loaded peg with a rounded end extending radially from a port penetrating that fiat cord section registering with the locking recess when the spout of the toner container is seated within the filler snout for releasably latching an inserted spout of a toner container within the filler snout.

7. A filler snout assembly attachable to printer and copier machines for receiving an outlet a toner container, comprising, in combination:

a) a cylindrical base housing having an axis, a proximal end and a distal end, the proximal end adapted to be mounted on the machine;

b) an annular platform extending from the cylindrical housing at an oblique angle from the axis;

c) a ring flange formed coaxially with the platform; and d) a filler snout mounted on the ring flange for swiveling from a stow position where the filler snout extends vertically upward from the annular platform to a load position where the filler snout extends beyond the distal end of the base housing adapted to receive the outlet of the toner container.

8. A device of claim 7 wherein the ring flange is provided by at least two semicircular flange bearings formed from a rigid polymeric material and wherein the filler snout has an exterior annular channel snugly receiving the semicircular flange bearings sealing the filler snout against said ring flange while permitting the filler snout to swivel on the annular platform between the stow position and the load position.

9. The device of claim 8 wherein the filler snout has a cylindrical mouth with a conically flared end having a flat cord section for receiving and mating with a flat cord section on an exterior, conically tapering, shoulder surface located at a base of a spout of the toner container, and further including:

e) a detent latching mechanism mounted exterior to the flat cord section of the conically flared end of the cylindrical mouth of the filler snout having a spring loaded peg with a rounded end axially penetrating into the mouth in registry with a latching recess in the exterior shoulder surface of a toner container spout received in the filler snout for latching the spout of the toner container within the snout.

10. The device of claim 9 and further comprising:

f) a multi-function handle mounted on the filler snout, the filler snout swiveling on the annular platform responsive to tangential forces manually applied to the filler snout using the handle.

11. The device of claim 10 wherein the toner container includes a removable lid having a displaceable diaphragm closing the spout of the container, and further including:

g) a pin assembly mounted in the filler snout comprising, in combination:

(i) a bushing having an opening into the cylindrical mouth of the filler snout integral with a sidewall of the cylindrical mouth;

(ii) a shaft received within and rotatable within the bushing having an end extending coaxially from the bushing exterior the sidewall of the cylindrical mouth;

(iii) an arm secured to the shaft with an end extending through the opening into the cylindrical mouth;

(iv) a long pin secured at the end of the arm extending perpendicularly upward from the arm in the mouth toward the conically flared end; and wherein the multi-function handle is fastened to the extending end of the shaft for rotating the shaft within the bushing moving the pin upward against the displaceable diaphragm of the removable lid closing the spout of a toner container inserted into the filler snout to dislodge and displace the diaphragm from the lid.

* * * * *